United States Patent [19]

Ledesky

[11] 4,212,493

[45] Jul. 15, 1980

[54] APPARATUS FOR ASSISTING SEMI-INVALID PERSON TO WALK

[76] Inventor: Eugenia A. Ledesky, 323 W. 14th St., New York, N.Y. 10014

[21] Appl. No.: 945,638

[22] Filed: Sep. 25, 1978

[51] Int. Cl.[2] ..... A47D 13/04

[52] U.S. Cl. ..... 297/6; 272/70.3; 135/67

[58] Field of Search ..... 297/6, 5; 272/70, 70.3, 272/58, 70.4; 280/42; 135/67

[56] References Cited

U.S. PATENT DOCUMENTS

| | | | |
|---|---|---|---|
| 1,448,783 | 3/1923 | Blewitt et al. | 272/70.3 |
| 2,129,260 | 9/1938 | Bowser | 297/6 |
| 2,362,466 | 11/1944 | Carter | 297/6 |
| 2,433,969 | 1/1948 | Wood | 297/6 |
| 2,759,525 | 8/1956 | Ries | 297/6 X |
| 2,798,533 | 7/1957 | Frank | 297/6 |
| 3,993,349 | 11/1976 | Neufeld | 297/6 |
| 4,046,374 | 9/1977 | Breyley | 297/6 |

*Primary Examiner*—Roy D. Frazier
*Assistant Examiner*—Peter A. Aschenbrenner
*Attorney, Agent, or Firm*—Quaintance, Murphy & Richardson

[57] ABSTRACT

An apparatus is disclosed having a generally U-shaped horizontal top rail delineating the front and two sides of the apparatus, the rear of the apparatus being open. Four legs depend from the top rail in the general form of a cubic trapezoid delineating the four upright edges of the apparatus. A seat is pivotally mounted to a first of the four legs and is lockingly engageable with the second of the four legs thereby closing the rear of the apparatus. A knee pad is located between the third and fourth legs and situated with respect to the seat so as to permit the user of the apparatus to assume a standing or a semi-sitting position.

16 Claims, 8 Drawing Figures

APPARATUS FOR ASSISTING SEMI-INVALID PERSON TO WALK

BACKGROUND OF THE INVENTION

1. Field of the Invention

This invention relates to improvements in walking devices of the character which employ a mobile or displaceable frame to support a portion of the weight of a person and thereby facilitate the walking action of the person. The invention further relates to such improvements in walking devices of this character having a seat for permitting the user of the walking device to periodically rest.

2. Description of the Prior Art

Many prior art devices have been proposed for assisting semi-invalid persons in the act of walking. Only a few of the prior art devices include a seat which would permit the user of the apparatus to rest when so desired. Of the devices employing seats, they were typically complex in structure, heavy in weight, and unnecessarily cumbersome.

For the semi-invalid person, particularly those of afflicted with arthritis or having suffered hip or knee injuries, the very act of moving from a full sitting to a standing position requires intense concentration and extreme effort. It was therefore a common experience of users of prior art devices which did employ seats that the rest afforded by the seat was offset by the exertion required to reassume a standing position ready to walk.

It is, therefore, an object of this invention to construct a simple, lightweight walker of minimum outside dimensions, having a seat to permit the user of the apparatus to periodically rest. It is another object of the present invention to provide such a lightweight walker in which the user of the apparatus assumes only a semi-sitting position during any resting period, thereby minimizing the effort necessary to reassume the standing or walking position. Still another object of the present invention is to provide a walker supported on wheels which includes a breaking means manipulatable by the user of the apparatus to steady the walking device when necessary.

SUMMARY OF THE INVENTION

These and other objects of the present invention are satisfied by an apparatus which comprises a generally U-shaped horizontal top rail delineating the front and two sides of the apparatus, the rear of the apparatus being open. Four legs depend from the top rail in the general form of a cubic trapezoid delineating four upright edges of the apparatus. A seat is pivotally mounted to one of the rear legs and engageable with the other rear leg thereby closing the rear of the apparatus. A knee pad is located between the front two legs and is situated with respect to the seat so as to permit the user of the apparatus to assume any stance between a standing and a semi-sitting position.

The apparatus can further comprise an inverted U-shaped handle fixed vertically to the front portion of the top rail. A flat U-shaped tray can be fixed horizontally to the top surface of the top rail thereby providing a convenient surface for use by the user of the apparatus.

Preferably, each of the four legs of the apparatus comprises an upper portion and a lower portion telescopically adjustable with respect to the upper portion. In a preferred embodiment the top rail and the rear legs are unitary while the front two legs are form of a single inverted U-shaped element. The apparatus can further comprise an horizontally disposed U-shaped bracing rail joining the four legs approximately at the respective midpoints. The knee pad can be most conveniently mounted on this bracing rail between the front two legs. A pair of bottom bracing rails can also be provided, each rail joining a front leg and a rear leg on a single side of the apparatus near the lower extremeties thereof.

The apparatus can also comprise a pair of supports or standards having fixed to their upper ends crutch saddles, the standards of support being mounted to the sides of the apparatus and extending upwardly above the top rail to be positioned in conventional manner comfortably beneath the armpits of the user of the apparatus.

In a further preferred embodiment wheels are fixed to and support the lower extremities of the four legs. A brake means engageable with at least two of said wheels prevents the rotation thereof when so desired of the user of the apparatus. In a preferred embodiment, the brake means comprises a wheel engageable member situated in the immediate proximity of the wheel. A cable is attached to the wheel engageable member and extends therefrom through at least a major portion of the interior of the leg supported by the wheel to the vicinity of the top rail. A handle is mounted on the top rail and is attached to the cable for manipulating the same.

In a preferred embodiment, the handle attached to the braking cable comprises a vertically oriented plunger with the cable fixed to the lower end thereof. The plunger is engageable with a segmented rack having a longitudinal slot extending therethrough fixed to the top rail of the apparatus. Biasing means for biasing the plunger toward a rack-engaging position is also included. A further biasing means is situated at a lower end of this cable for biasing the wheel-engageable member away from wheel engagement. Preferably, a brake means of the kind outlined is provided for the two front wheels of the apparatus.

A principal feature of the apparatus is the positioning of the knee pad with respect to the seat so as to permit the user of the apparatus to assume a standing or a semi-sitting position. The term semi-sitting position is adopted herein to refer to a stance which can be viewed as being approximately halfway between a full standing position where the femur is vertically oriented and a full sitting position where the femur is horizontally oriented. The energy required to move from a semi-sitting position to a full standing position ready to walk is recognizeably considerably less than that required to move from a full sitting to a standing position. This savings in energy and effort on the part of a patient required by his physical condition to employ a walker is considerable. The advantage provided by this feature has an overall beneficial effect inasmuch as the person will be thereby encouraged to walk more thus increasing the strength and/or coordination required for walking in the absence of the present aid.

Another feature of the present apparatus is the provision of a wheeled walker having a unique brake mechanism easily manipulated by the user of the apparatus. The brake mechanism is designed such that the cable control is effected through the interior of hollow members forming the apparatus, thereby all but negating the possibility of an interference with the brake mechanism by extraneous objects such as furniture and the like.

This feature has the advantage of increasing the maneuverability of the apparatus in even close quarters thereby permitting the person required to use the apparatus by reason of their health access to portions of their environment which might otherwise be inaccessible. The concommitant increase in self-assurance due to the lack of dependency on others represents yet another beneficial effect of the present apparatus.

Other features and advantages of the present invention will become apparent to those skilled in the art from a further consideration of the following description of preferred embodiments taken together with the accompanying figures.

DESCRIPTION OF PREFERRED EMBODIMENTS

Figure 1:
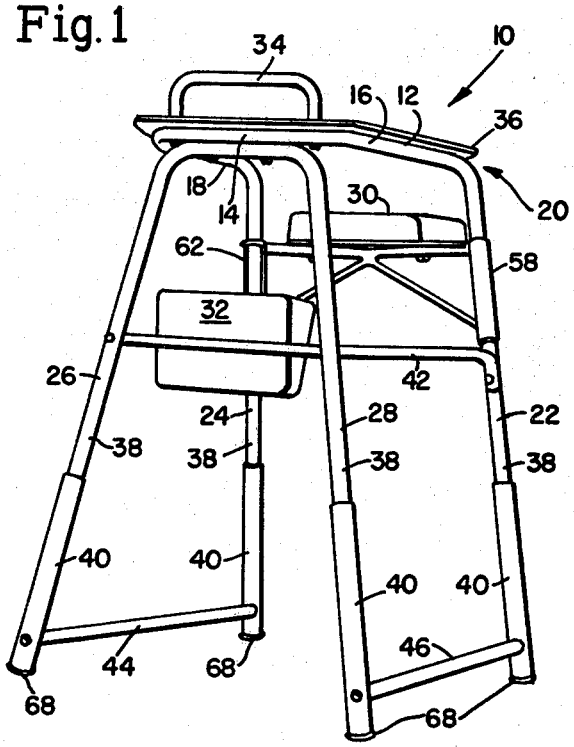
FIG. 1 is a perspective view of one embodiment of a walker apparatus according to the present invention as viewed from a front quarter of the apparatus.
Figure 2:
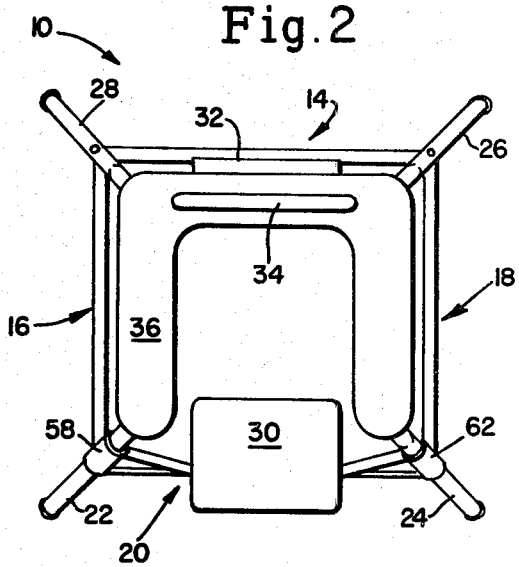
FIG. 2 is a plan view of the apparatus illustrated in FIG. 1.

A first preferred embodiment of an apparatus 10 according to the present invention for assisting a semi-invalid person to walk is illustrated in FIGS. 1 and 2. The apparatus 10 comprises a generally U-shaped horizontal top rail 12 delineating the front 14 and two sides 16 and 18 of the apparatus 10, the rear 20 of the apparatus being open. Four legs 22, 24, 26, 28 depend from the top rail in the general form of a cubic trapezoid delineating the four upright edges of the apparatus 10. A seat 30 is pivotally mounted to a first of the four legs 22 and engageable with the second of the four legs 24 closing the rear 20 of the apparatus. A knee pad 32 located between the third and fourth of the four legs 26 and 28 is situated with respect to the seat 30 so it can permit the user of the apparatus to assume a standing or a semi-sitting position when the seal is closed.

The embodiment of the apparatus 10 illustrated in FIGS. 1 and 2 also includes an inverted, U-shaped handle 34 fixed vertically to the front 14 of top rail 12. A flat, U-shaped tray 36 is fixed horizontally to the top surface of top rail 12. Each of the four legs are illustrated to comprise an upper portion 38 and a lower portion 40 telescopically adjustable with respect to the upper portion 38. This telescopic adjustment of the legs assists in positioning the knee pads at the correct elevation to interact with the knees of the person using the apparatus. As illustrated, the top rail 12 and first and second legs 22 and 24 are unitary in construction. Similarly, the front two legs 26 and 28 constitute a single, unitary inverted U-shaped structure.

A horizontally disposed U-shaped bracing rail 42 joins the four legs 22–28 approximately at their respective midpoints. The knee pad 32 is mounted on the bracing rail 42 between the front two legs 26 and 28. An additional pair of bottom bracing rails 44 and 46 are included. Each bottom bracing rail 44 and 46 joins a front leg and a rear leg on a single side of the apparatus 10.

Figure 3:
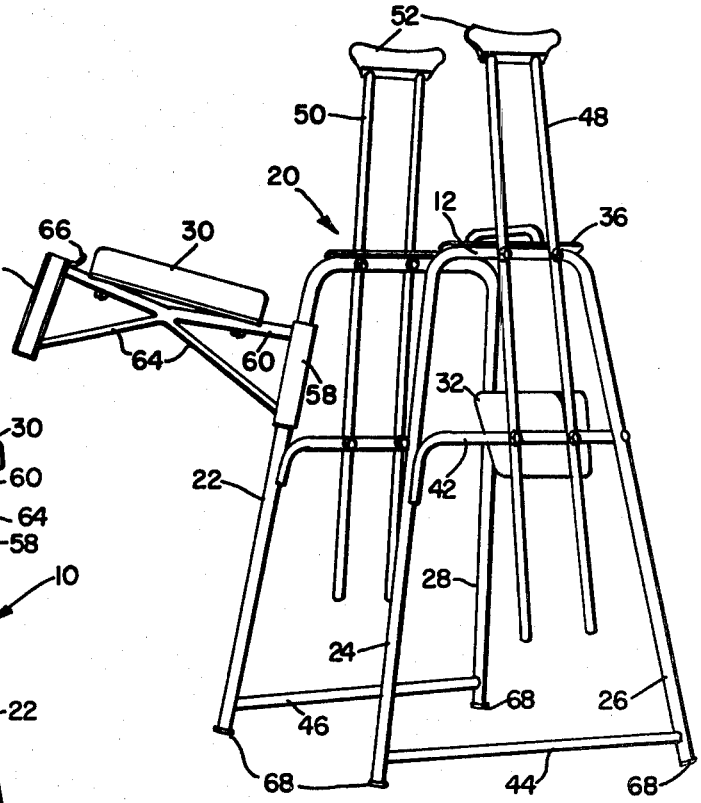
FIG. 3 is a perspective view of another embodiment of an apparatus according to the present invention as viewed from a rear quarter with the seat mechanism in an "open" position.
Figure 4:
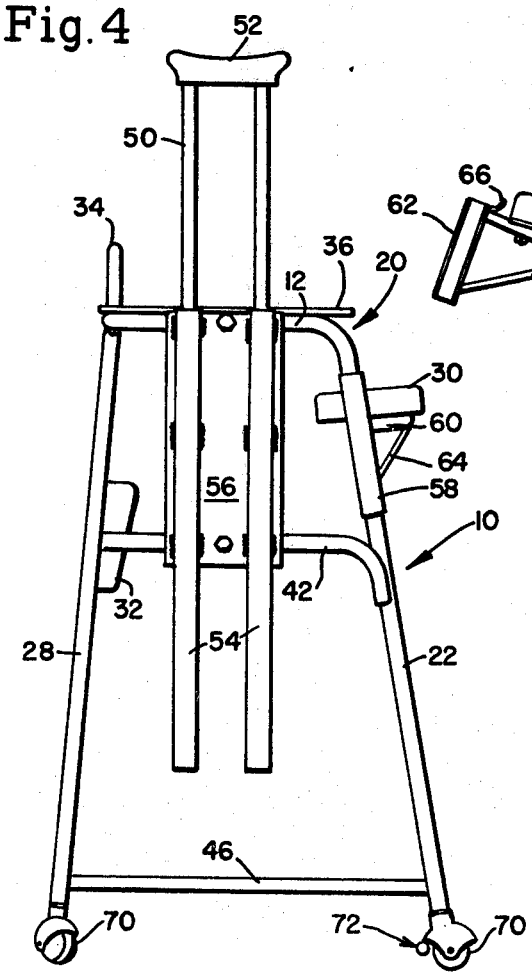
FIG. 4 is a side elevation view of an apparatus similar to that illustrated in FIG. 3 but with the addition of wheels on the lower extremities of the legs.

As illustrated in FIGS. 3 and 4, the apparatus 10 can also comprise a pair of standards 48 and 50 having crutch saddles 52 fixed to their upper ends. Each of the standards 48 and 50 are mounted upright on a side of the apparatus 10 and are vertically adjustable above the top rail 12. The vertical adjustability can be achieved by any of several different methods which are conventional and well known in the art. As illustrated in FIG. 3, the standards 48 and 50 are merely bolted to the top rail 12 and bracing rail 42 while in FIG. 4 the standard 48 is slidably received within receiving tubes 54 which are in turn welded to supporting plate 56 which is bolted to the top rail 12 and bracing rail 42. Within receiving tubes 54 the standards 48 are securely supported, preferably in a slightly cushioned manner by the means of a padded stop interacting with the lower end of standard 48.

The seat 30 is pivotally supported to leg 22 by a sleeve member 58 encompassing a portion of leg 22. Seat supporting rail 60 is fixed thereto and extends beneath seat 30 to a vertically oriented, trough-shaped leg-engaging member 62 which engages leg 24 when the seat is closed to further support seat 30. The seat supporting rail 60 gains further strength from diagonal rods 64 extending from the center of the seat supporting rail 60 toward the lower ends of sleeve 58 and leg engaging member 62. A lock means 66 is fixed to seat supporting rail 60 adjacent seat 30 for releasably locking the seat 30 to leg 24 when in the "closed" position shown in FIGS. 1, 2 and 4. When the lock means 66 is disengaged from leg 24, the seat 30 can be pivoted to an "open" position as illustrated in FIG. 3 thereby permitting easy access to the walker device by a person desiring to use the apparatus.

Figure 6:
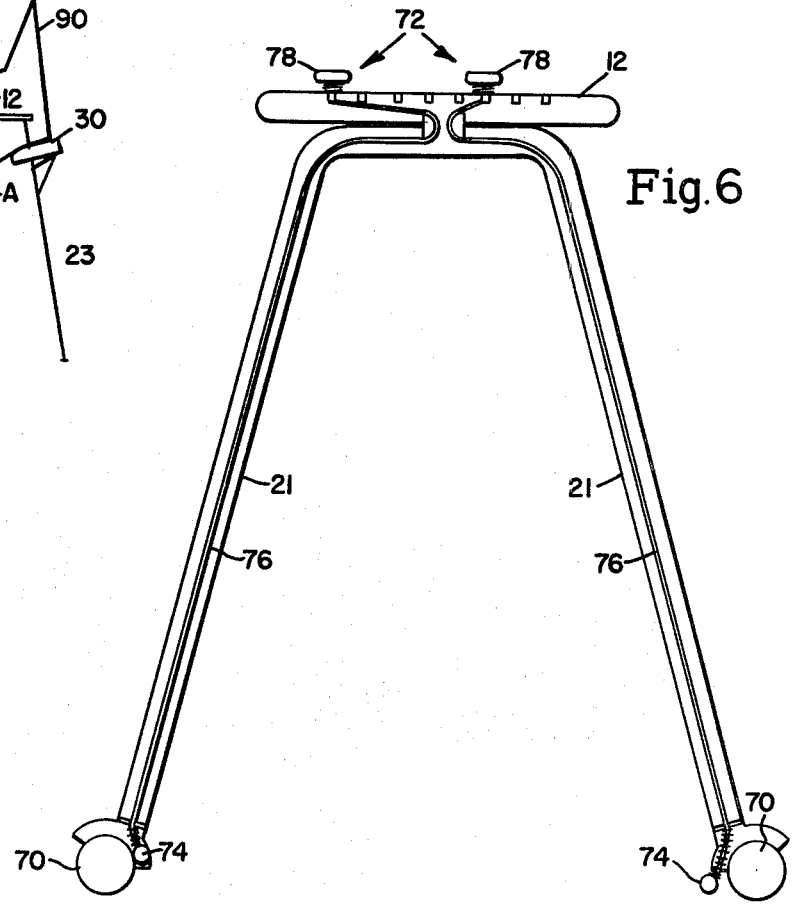
FIG. 6 is a schematic view of a brake mechanism employable in connection with the present apparatus.
Figure 8:
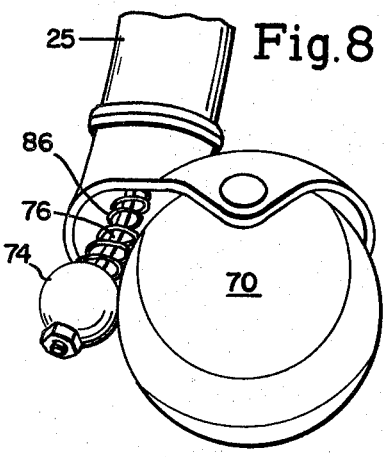
FIG. 8 is a perspective view from a bottom quarter of a single leg illustrating a preferred embodiment of the wheel engaging portion of the brake mechanism.

While in FIGS. 1, 2 and 3 the walker apparatus is illustrated to have feet 68 on the bottom of each leg which can be rubber tips or otherwise made resistent to undesirable sliding motion, FIGS. 4, 6 and 8 illustrate an apparatus 10 having wheels 70 located on the bottom end of the legs. Wheel supported walkers have particular utility where the infirmities of the person do not permit any substantial lifting of objects, including the walker, thereby preventing the typical "lift and shift" motion required of a non-wheeled walker. Nonetheless, it is often desirable that the rolling motion of the wheels 70 be stopped so that the walker can give firm steady support to the individual desiring to use the same. Thus, embodiments of the present invention which include wheels also, preferably, include brake means 72 engageable with at least one of said wheels 70 for preventing the rotation thereof.

FIG. 6 illustrates schematically an appropriate brake means for use in the present invention. The brake means 72 comprises a wheel engageable member 74 situated in the immediate proximity of wheel 70. A cable 76 attached to the wheel engageable member 74 extends therefrom preferably through at a major portion of the interior of legs 21 supported by wheel 70 to the vicinity of top rail 12. A brake handle 78 mounted on top rail 12 is attached to cable 76 for manipulating the same. Preferably, brake means are provided to interact with wheels 70 found at the base of both front legs 25.

Figure 7:
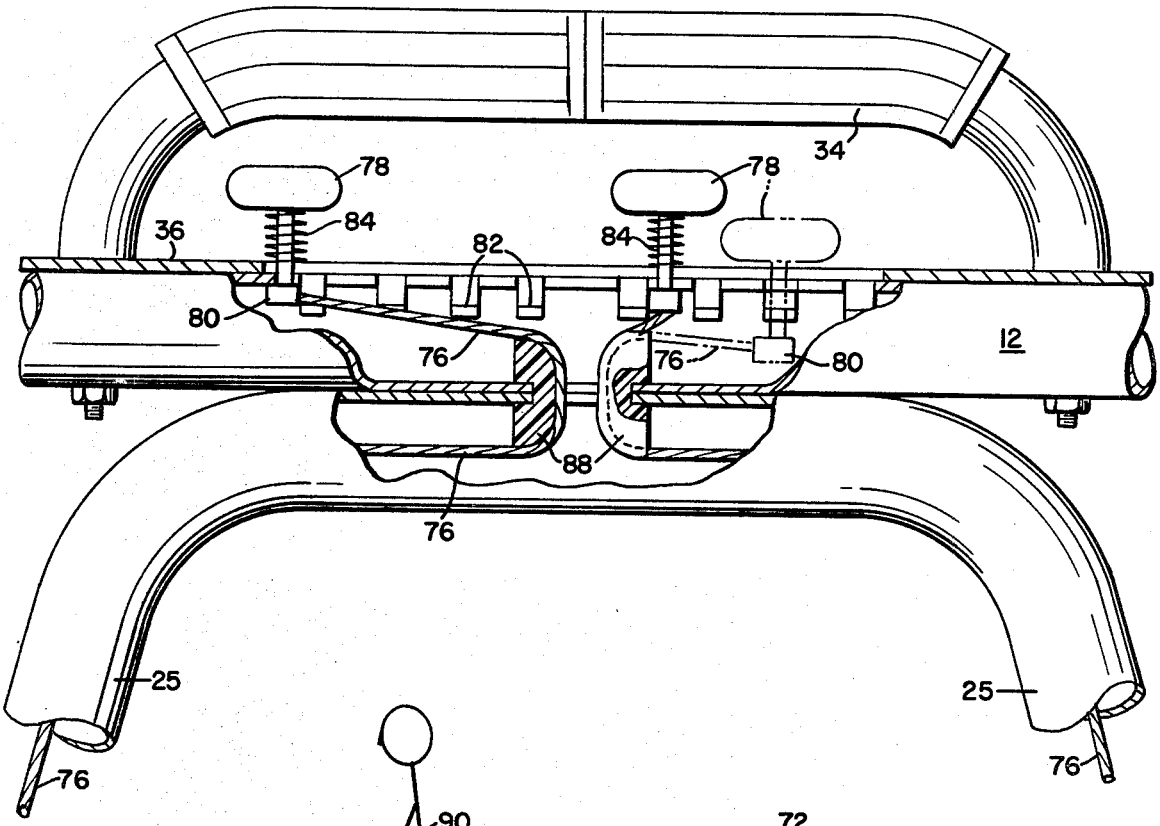
FIG. 7 is a sectional detail view of a preferred embodiment of the upper portion of the brake mechanism employable in the present invention.

In a particularly advantageous embodiment, illustrated in FIGS. 7 and 8, the brake handle 78 comprises a plunger, having the cable 76 attached to a lower end 80 thereof. A segmented rack 82 having a longitudinal slot extending therethrough is fixed to said top rail 12, the lower end 80 of plunger 78 interacting with the individual members of rack 82 by means of a vertical displacement of the plunger. Biasing means 84 are provided for biasing the plunger 78 toward a rack-engaging position. As shown in FIG. 7, the brake handles are located beneath handle 34 and extend through tray 36 for convenient manipulation by the occupant of the apparatus. The cable 78 extends downward through the interior of front legs 25 to the lower end of the leg illustrated in FIG. 8. The wheel engaging member 74 is fixed to the lower end of cable 78 and positioned so as to frictionally engage wheel 70 when plunger 78 is moved to the outermost position illustrated on the left side of FIGS. 6 and 7. When plunger 78 is moved to the innermost position, illustrated on the right side of FIGS. 6 and 7, biasing means 86 at the lower end of cable 78 disengages wheel engaging member 74 from its frictional engagement with wheel 70. Other cable directing means 88 are included as necessary to prevent twisting and abrasive friction between the cable and the structural members of the apparatus.

Figure 5:
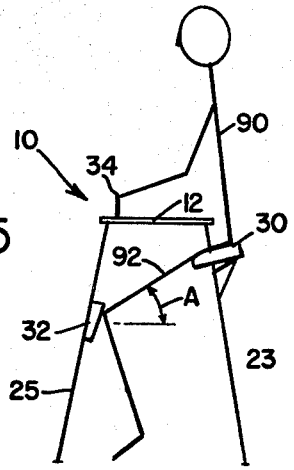
FIG. 5 is a stick diagram illustrating the posture assumed by a person employing an apparatus according to the present invention when in a "semi-sitting" stance.

FIG. 5 illustrates in stick form the relationship between the apparatus 10 and the user thereof 90 when the semi-sitting position previously described. The occupant 90 is shown in a position such that the femur 92 is angled at angle A with respect to the horizontal. Where angle A is maintained at about 45° or more, the energy required of occupant 90 to move from the illustrated position to a standing position is kept at a minimum. Yet the illustrated position is still restful to the occupant. Note that a major portion of the body weight is supported by seat 30 yet knee pad 32 also acts in a semi-supporting role, there being a compressional force exerted on kneepad 32 by femur 92. Although the invention has been described in considerable detail with reference to certain perferred embodiments thereof, it is to be understood that variations and modifications can be affected within the spirit and scope of the invention as described above and as defined in the appended claims.

What is claimed is:

1. An apparatus for assisting a semi-invalid person to walk comprising:

(a) a generally U-shaped top rail delineating the front and two sides of the apparatus, the rear of the apparatus being open, (b) four legs depending from the top rail in the general form of a cubic trapezoid delineating the four upright edges of the apparatus, the front two legs being formed of a unitary U-shaped member, the top rail and the unitary member being co-joined along the front edge of the apparatus, (c) a seat, pivotally mounted to a first of the rear two legs and having lock means lockingly engageable with a second of the rear two legs for closing the rear of the apparatus, and (d) a knee pad mounted between the front two legs and situated with respect to the seat so as to permit the user of the apparatus to assume any stance between a standing and a semi-sitting position.

2. The apparatus of claim 1 further comprising an inverted U-shaped handle fixed vertically to the front portion of said top rail.

3. The apparatus of claim 1 further comprising a flat, U-shaped tray fixed horizontally to the top surface of said top rail.

4. The apparatus of claim 1 wherein the four legs each comprise an upper portion and a lower portion telescopically adjustable with respect to the upper portion.

5. The apparatus of claim 1 further comprising a horizontally disposed, U-shaped bracing rail joining said four legs approximately at their respective midpoints, said knee pad being mounted on the bracing rail between the front two legs.

6. The apparatus of claim 1 further comprising a pair of bottom bracing rails, each rail joining a front leg and a rear leg on a single side of the apparatus near the lower extremity thereof.

7. The apparatus of claim 1 further comprising a pair of crutch saddle supports each fixed to a side of the apparatus and extending upwardly above said top rail.

8. The apparatus of claim 1 wherein the top rail and the rear two legs are unitary.

9. The apparatus of claim 1 further comprising wheels fixed to and supporting the lower extremities of at least two of said four legs.

10. The apparatus of claim 9 further comprising brake means engageable with at least two of said wheels for preventing the rotation thereof.

11. The apparatus of claim 10 wherein said brake means comprises:

(a) wheel-engageable members situated in the immediate proximity of a wheel, (b) a cable attached to the wheel-engageable member and extending therefrom through at least a major portion of the interior of the leg supported by the wheel to the vicinity of the top rail, and (c) a handle mounted on the top rail and attached to said cable for manipulating the same.

12. The apparatus of claim 11 wherein said handle comprises a plunger having said cable fixed to a lower end thereof engageable with a segmented rack having a longitudinal slot extending therethrough fixed to said top rail and biasing means for biasing the plunger toward a rack-engaging position.

13. The apparatus of claim 11 further comprising a segmented rack having a longitudinal slot extending therethrough fixed to said top rail.

14. The apparatus of claim 11 further comprising biasing means situated at a lower end of said cable for biasing said wheel-engageable member away from wheel engagement.

15. The apparatus of claim 10 wherein said brake means are provided to be engageable with the wheel situated on the lower extremities of both front legs.

16. The apparatus of claim 10 further comprising a pair of standards having crutch saddles fixed to their upper ends, each mounted upon a side of the apparatus and vertically adjustable above said top rail.

* * * * *